US005522741A

United States Patent [19]

Yun

[11] Patent Number: 5,522,741

[45] Date of Patent: Jun. 4, 1996

[54] AMPHIBIAN BICYCLE

[75] Inventor: Oi C. Yun, Pusan, Rep. of Korea

[73] Assignee: Bistar Co., Ltd., Pusan, Rep. of Korea

[21] Appl. No.: 418,027

[22] Filed: Apr. 6, 1995

[30] Foreign Application Priority Data

Dec. 14, 1994 [KR] Rep. of Korea ..... 94-34399

[51] Int. Cl.[6] ..... B63H 16/20

[52] U.S. Cl. ..... 440/29; 114/61; 114/354

[58] Field of Search ..... 440/12, 21, 26, 440/27, 29, 30, 31; 114/61, 345, 352–354, 270

[56] References Cited

U.S. PATENT DOCUMENTS 3,473,502 10/1969 Wittkamp ..... 114/345
4,170,188 10/1979 Jamison, Jr. ..... 440/30
4,936,801 6/1990 Herrit ..... 440/12
5,226,843 7/1993 Yun ..... 440/90
5,415,574 5/1995 Siviero ..... 440/12

*Primary Examiner*—Edwin L. Swinehart
*Attorney, Agent, or Firm*—Birch, Stewart, Kolasch & Birch

[57] ABSTRACT

An amphibian bicycle wherein the central screw portion for the rear wheel hub part coupled with the large circular disc plate, and that for the inner body end coupled with the small circular disc plate have screw portions in a direction contrary to that for the gears, whereby loosening of the gears is prevented in the case of fastening the large circular disc plate integral with the multi-stage gears with the bolts during its forward and backward motions on the water. In the case of operations on land, all the related bolts are separated for the driving operation.

In case of operation on water, the air tubes having a plurality of air chambers, semi-circle frames and fixing pipes uniformly distribute and support the weight of the bicycle and the human body.

4 Claims, 12 Drawing Sheets

AMPHIBIAN BICYCLE

BACKGROUND OF THE INVENTION

1. Field of the Invention

The present invention relates to further improving amphibian bicycles as recited in U.S. Pat. No. 5,226,843.

2. Description of the Prior Art

The amphibian bicycle disclosed in U.S. Pat. No. 5,226,843 described above has been found to possess certain shortcomings wherein during motion the screws tend to loosen due to the coupling of the bearing and the gear only; the fixing pipe fixed to the support frame is not fixed to a position where the weight of the bicycle is uniformly distributed and does not have sufficient rigidity since it is attached to the handle portion and the rear wheel supporter; and since the air tubes fixed to both support frames are constructed to be separated toward the front and the rear of both sides, they may meet with more water resistance followed by wave rolling and pitching. Therefore, the bicycle speed may be decreased, more or less, under such load despite more pedalling force and furthermore the fixing pin might be loosened easily arising from the web moving freely in the tire when meeting with water resistance during quick turning operations, and the like.

SUMMARY OF THE INVENTION

It is therefore an object of the present invention to provide an amphibian bicycle which solves the above-mentioned problems encountered in the use of the amphibian bicycle mentioned in U.S. Pat. No. 5,226,843 by forming the central screw portion of the large circular disc plate in the screw portion of hub side of the rear wheel and the central screw portion of the small circular disc plate in the screw portion around the outside of the end portion of the inner body, in opposite directions to the screw direction of the gear. Therefore, in the case of the large circular disc plate combined integral with the multistage gear by bolts, loosening of the gear during the forward and backward motion on the water would be prevented. The bolts are removed for land operation. In the case where the amphibian bicycle is operated on water, the air tubes having multi-air chambers are provided to uniformly distribute and support the weight of the human body and the bicycle. Following the teachings of the present invention meets with less water resistance and less rocking to produce high speed pleasure by the simple pedalling manipulation without any further physical strength. Additionally due to its easier dismantling and assembling methods, together with compact volume, the bicycle can be carried to any location and thus one can enjoy this leisure sport to promote one's own health.

BRIEF DESCRIPTION OF THE DRAWING

These and other objects and aspects, as well as advantages of the present invention, will become clear by the following description of the present invention with reference to the accompanying drawings, wherein.

(A) In case of the forward and backward motions on water.

(B) In case of the forward motion on land.

Figure 9:
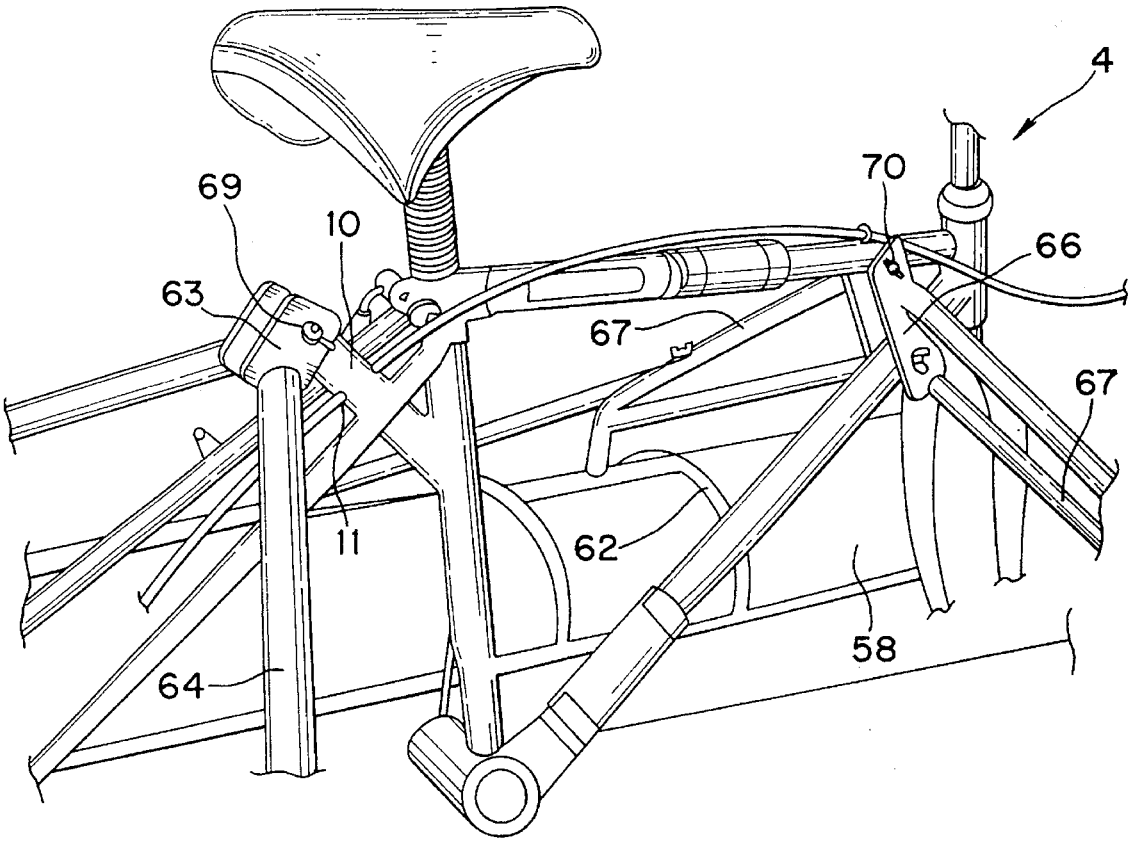
Figure 10:
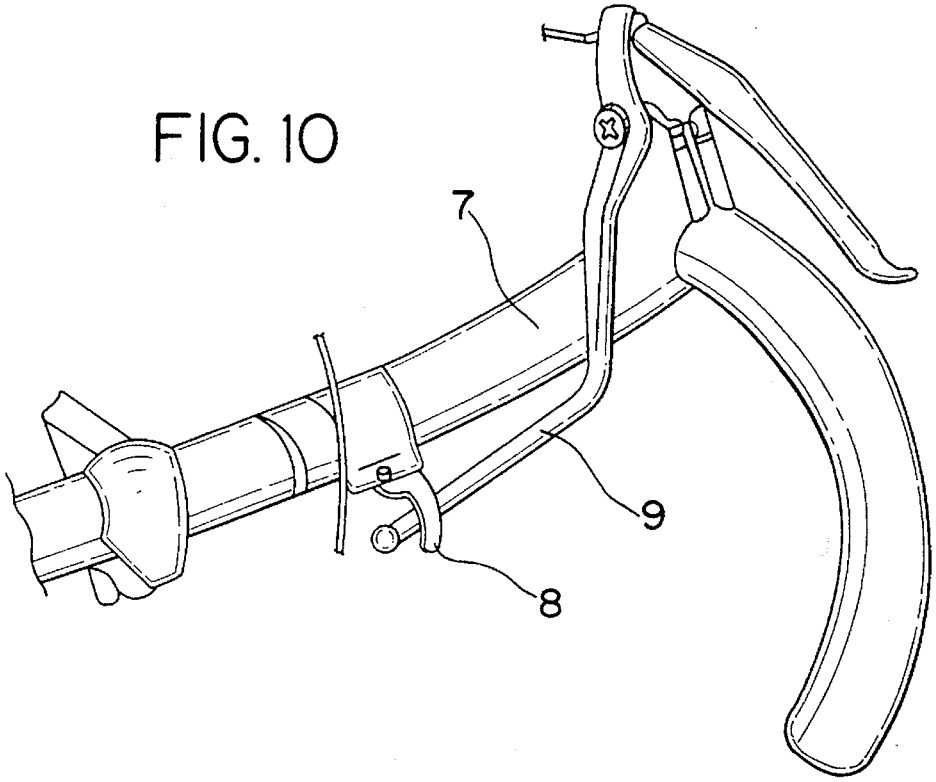
Figure 11:
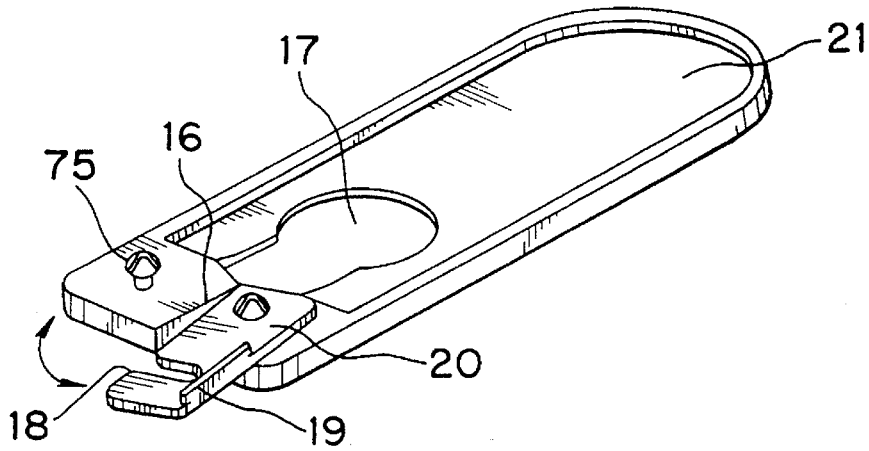
Figure 12:
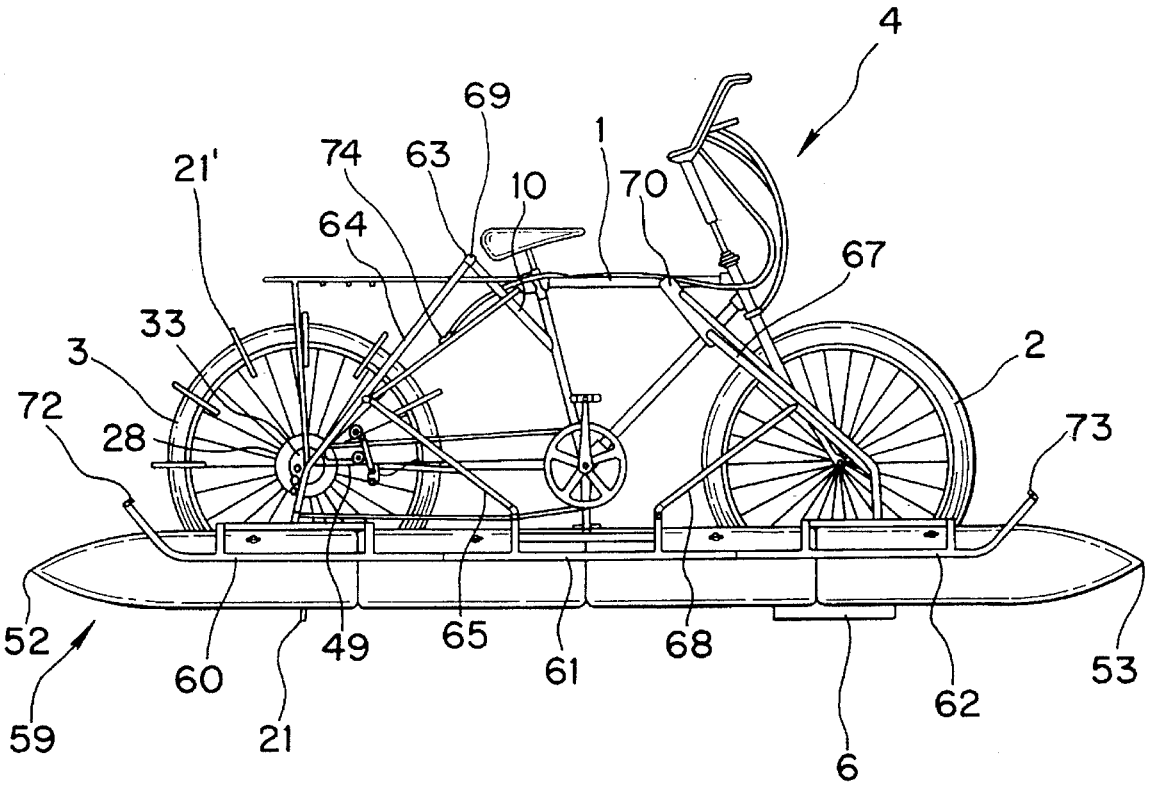
Figure 13:
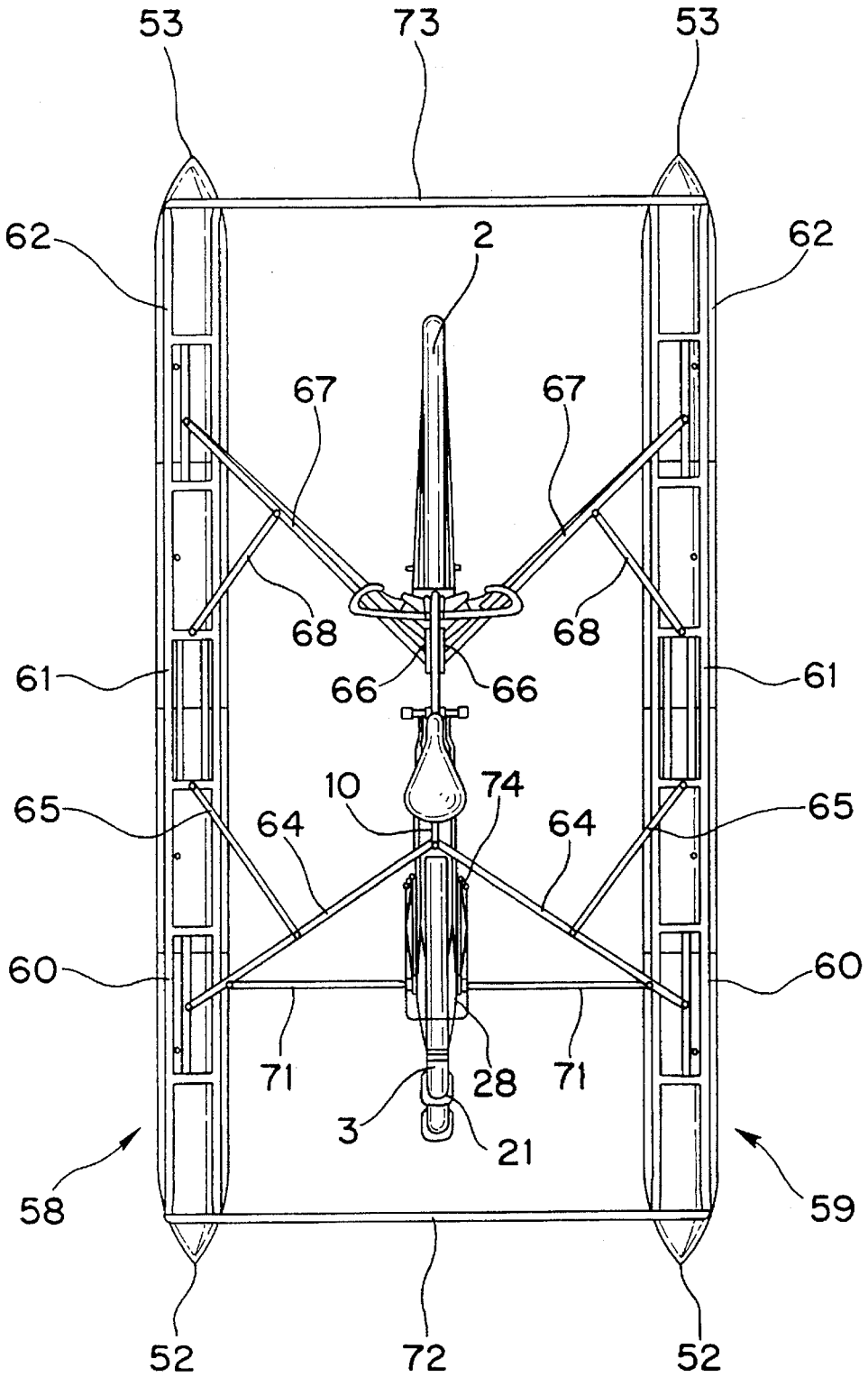
Figure 14:
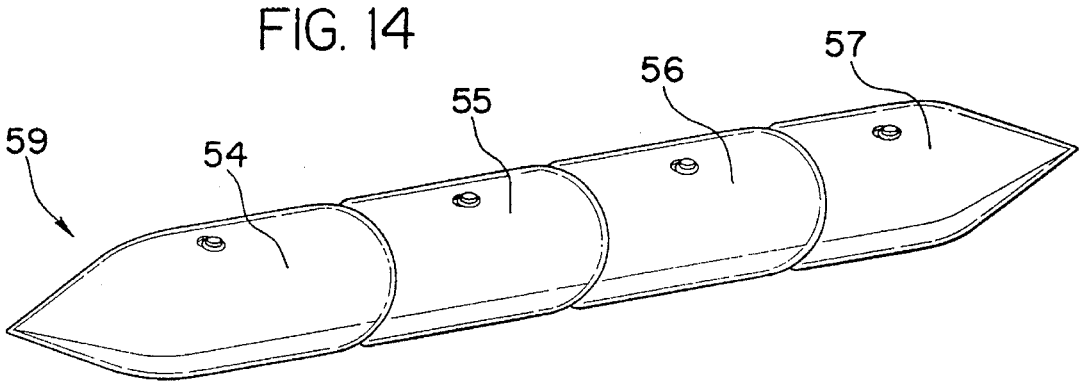
Figure 15:
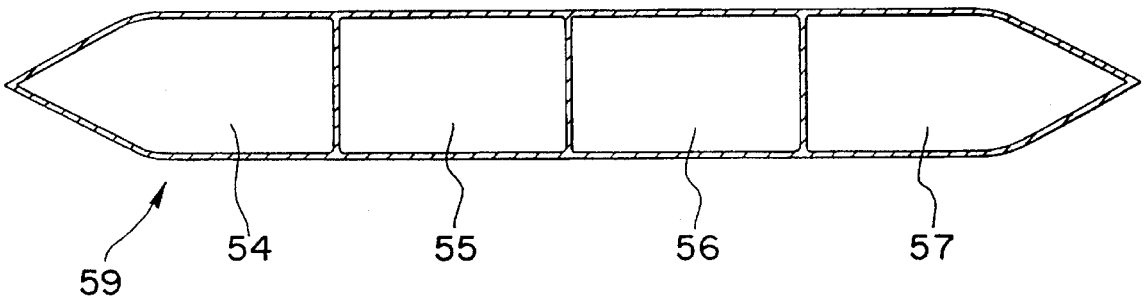

FIG. 9 is a perspective view showing the joining of the fixing pipe with the projecting pipe and frame according to the present invention;

FIG. 10 is a perspective view of the handle part according to the present invention;

FIG. 11 is a perspective view of the web according to the present invention;

FIG. 12 is a side view according to the present invention;

FIG. 13 is a top plane view according to the present invention;

FIG. 14 is a perspective view of the air tube according to the present invention;

FIG. 15 is a longitudinal cross-sectional view of FIG. 14; and

Figure 16:
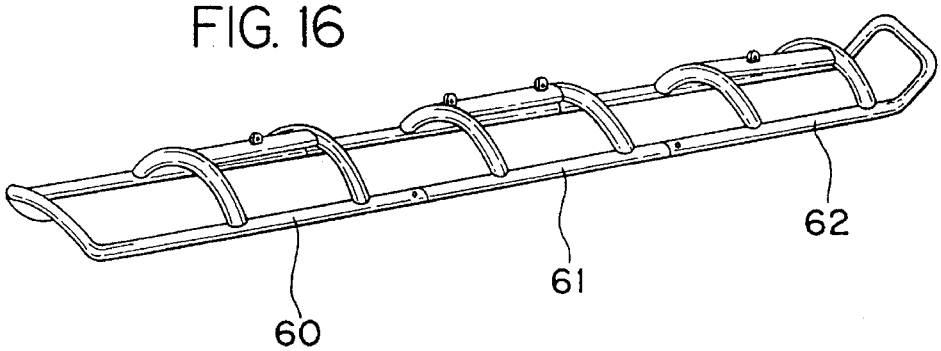

FIG. 16 is a perspective view of the frame supporting the air tube.

DESCRIPTION OF THE PREFERRED EMBODIMENTS

An embodiment of the amphibian bicycle according to the present invention will hereinafter be described with reference to FIGS. 1 to 16.

In the conventional bicycle 4 in which the front wheel 2 and rear wheel 3 are connected to the frame 1, direction controlling plate 6 with a tire guide 5 is fixedly mounted under the front wheel 2. The handle bar 7 is provided with the fixing hook 8 and the brake lever 9. The projecting pipe 10 which projects below the seat has a through hole 11 through which brake lines 14 and 15 are linked to the brake via suspension parts 12 and 13 joined at a given distance. Around the rear wheel the central opening 16 is provided adjacent to the wheel guide hole 17. The plurality of webs 21, 21' . . . are mounted with clamping hook 20 having the inner guide 18 and projecting part 19 the same distance apart. The central screw portion 25 of the large circular disc plate 24 is inserted in the outside screw portion 23 for the hub 22 of the rear wheel 3 and the facing large circular disc plate 28 provided with the bolt guide hole 27 within the inner gear 26 is fastened with the bolt 30 through the screw hole 29 for the facing, large circular disc plate 24. On the other hand, the central screw portion 34 for the small circular disc plate 33 is coupled with the screw portion 32 of the end portion of the gear inner body 31.

Further, around the inner portion of the hub 22 the screw hole 35 with the screw portion 36 is formed. The joint flange 38 with the screw hole 37 facing the screw hole 35 is fastened by the fixing bolt 39. The medium size circular disc plate 40 fixed with the gear 26 has a screw hole 41 and the screw portion 36 around the joint flange 38 is provided with a screw hole 42 through which the fixing bolt 45 fastens the medium circular disc plate 44.

The chain-adjusted speed controller 49 is fastened with the bolt 48 coupled with the screw hole 47 facing the rear chain 46 of the frame 1. The ratchet gearing stopper 51 of the upper moving part 50 is suspended or released depending on engagement or disengagement of the fixing bolt 48.

Both sides for the bicycle 4 is provided with projecting parts 52 and 53, and equi-divided semi-circular frames 60, 61 and 62 are supported by the air tubes 58 and 59 having a plurality of air injection chambers 54, 55, 56 and 57. The fixing pipe 64 is integral with the fixing piece 63, and the auxiliary pipe 65 with the projecting pipe 10 and the semi-circle frames 60 and 61. Further, fixing pipe 67 is coupled integral with the fixing piece 66 and auxiliary pipe 68 is linked with the upper and lower parts of the frame and the semi-circular frames 62 and 61 through bolts 69 and 70, respectively. On the other hand the auxiliary pipe 71 is linked with the axle of the rear wheel and the end portions for the front and rear sides are linked with fixing pipes 72 and 73 respectively. Elements 74, 75, and 76 indicate the brake, a fixing bolt, and a spring.

Figure 6:
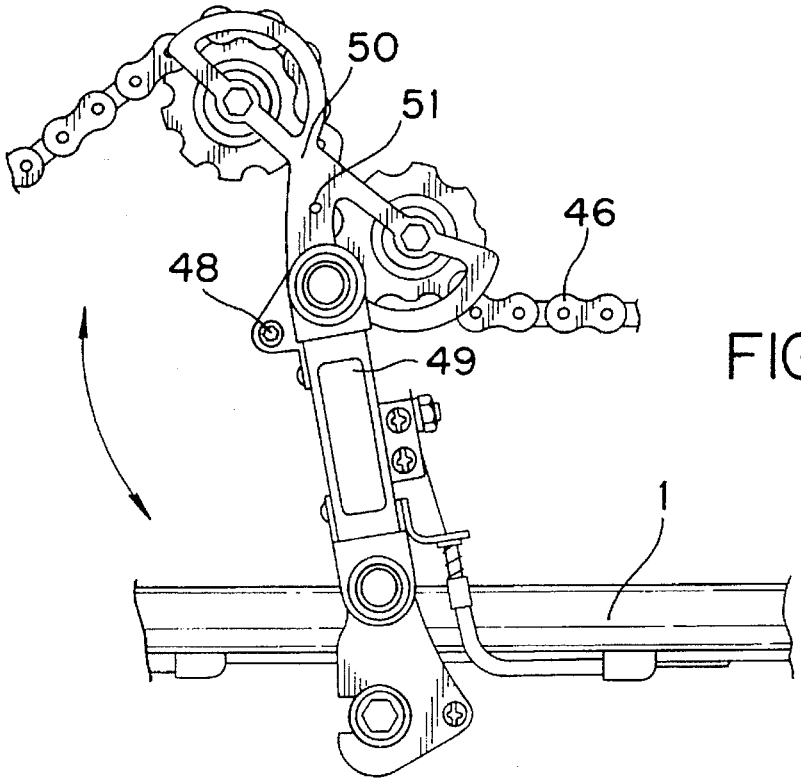
FIG. 6 is a front view showing the operating status of the chain-adjusted speed controller and the chain according to the present invention during the forward and backward motions on water.

The present invention constructed as described above can be applied to leisure sports: If one enjoys water activities, air is injected in the air injection chambers 54, 55, 56 and 57 of the air tubes 58 and 59 and then the semi-circle frames 60, 61 and 62 are fastened thereon. Then the bicycle is installed directly between the air tubes 58 and 59 after coupling the front and rear end portions thereof with fixing pipes 72 and 73, where the fixing piece 63, integral with the fixing pipe 64 and the projecting pipe 10, are fastened with bolt 69 at both sides thereof. Meanwhile, the auxiliary pipe 65 is linked to the semi-circle frames 60 and 61 at the other side. After connecting the auxiliary pipe 71 to the rear wheel axle, the fixing piece 66 of the fixing pipe 67 is fastened with the bolt 70 to the upper and lower rods of the frame. The other side is fixed to the semi-circle frames 61 and 62 together with the auxiliary pipe 68. Thereafter, the brake is widened by pulling and hanging the suspension part 12 at a given distance fixed to the brake lines 14 and 15 which are linked to the brake via the through hole 11 of the projecting pipe. The central cut off part 16 of the webs 21, 21' . . . disposed at a given distance around the rear wheel 3 is opened so that it may enter the wheel. The projecting part 19 of the clamping hook 20 is pushed toward the bolt so that the inner guide 18 may be inserted into the bolt by fixing. The direction, controlling plate 6 with the tire inner guide 5 is inserted and fastened in the lower side of the front wheel 2. The fastening bolt 48, screwed into the screw hole 47 of the chain-adjusted speed controller 49 mounted toward the rear side chain 46 of the frame 1 is unfastened and thereby the ratchet gearing stopper 51 on the upper moving part 50 is also unfastened. After adjusting as shown in FIG. 6 the screw hole 29 of the large circular disc plate 24 of the hub 22 of the rear wheel 3 is coupled with the bolt guide hole 27 of the large circular disc plate 28 and thereafter both disc plates are fastened with the bolt 30. On the other hand the central screw portion 34 of the small circular plate 33 is inserted and fastened in the screw portion 32. Thereafter the brake lever 9 is held under the fixing hook 8 of the handle bar 7. The handle and the direction controlling plate 6 are moved at the same time around the left and right directions without any rotating of the front wheel 2. By such a preparation as described above, the bicycle is floated on the water together with the air tubes 58 and 59 installed to both sides of the bicycle. In the case where a person sitting on the seat holds the handle and pedals both foot pedals, the chain 46 rotates the gear 26 which in turn rotates the rear wheel 3 forward. As the wheel guide hole 17 is pressed against the tire, the inner guide 18 of the clamping hook 20 locked with the bolt presses the webs 21, 21' . . . more tightly due to tire expansion. Meanwhile, the end portions in the form of projecting portions 53 of both air tubes 58 and 59 meet with less water resistance results in an increase in speed. During direction change by the handle of the bicycle 4 the direction controlling plate 6 fixed under the front wheel 2 serves for the rudder while moving simultaneously.

The direction change can be achieved in the direction of handle-adjusting. Since the fixing pipes 64 and 67 and the auxiliary pipes 65 and 68, integral with the fixing pieces 63 and 66, proportionately support the semi-circle frames 60, 61 and 62 and at the same time the auxiliary pipe 71 supports the rear axle of the bicycle and fixing pipes 72 and 73 support the rear axle at both front and rear sides, the both sides of the bicycle 4 will be stabilized without any rocking during rapid rotation of the pedals.

When moving from a forward motion to a backward motion on the water, if the pedal is pedaled backward in the opposite direction, the chain 46 is rotated in the backward direction. At this time the chain-adjusted speed controller 49 elastically and automatically adjusts the droop of the chain 46, and at the same time the central screw portion 25 of the large circular disc plate 24 is coupled with the screw portion 23 outside of the hub 22 of the rear wheel 3 in the opposite direction of the screw portion of the free wheel and the bolt 30 is fixed to the large circular disc plate 28 through the screw hole 29. The central screw portion 34 of the small circular disc plate 33, having the screw portion formed in the opposite direction to the screw direction of the gear 26, is coupled with the screw portion 32 formed around the outside of the end portion of the inner body 31. Thus the loosening of the screw is prevented and at the same time the projecting part 52 of the air tubes 58 and 59 decreases the water resistance to a minimum to smoothly achieve the backward motion. The air tubes 58 and 59 are provided with a plurality of divided chambers below the semi-circular frames 60, 61 and 62 of both sides. Thus even if air is exhausted from any one divided chamber, it is possible to use them safely.

Figure 1:
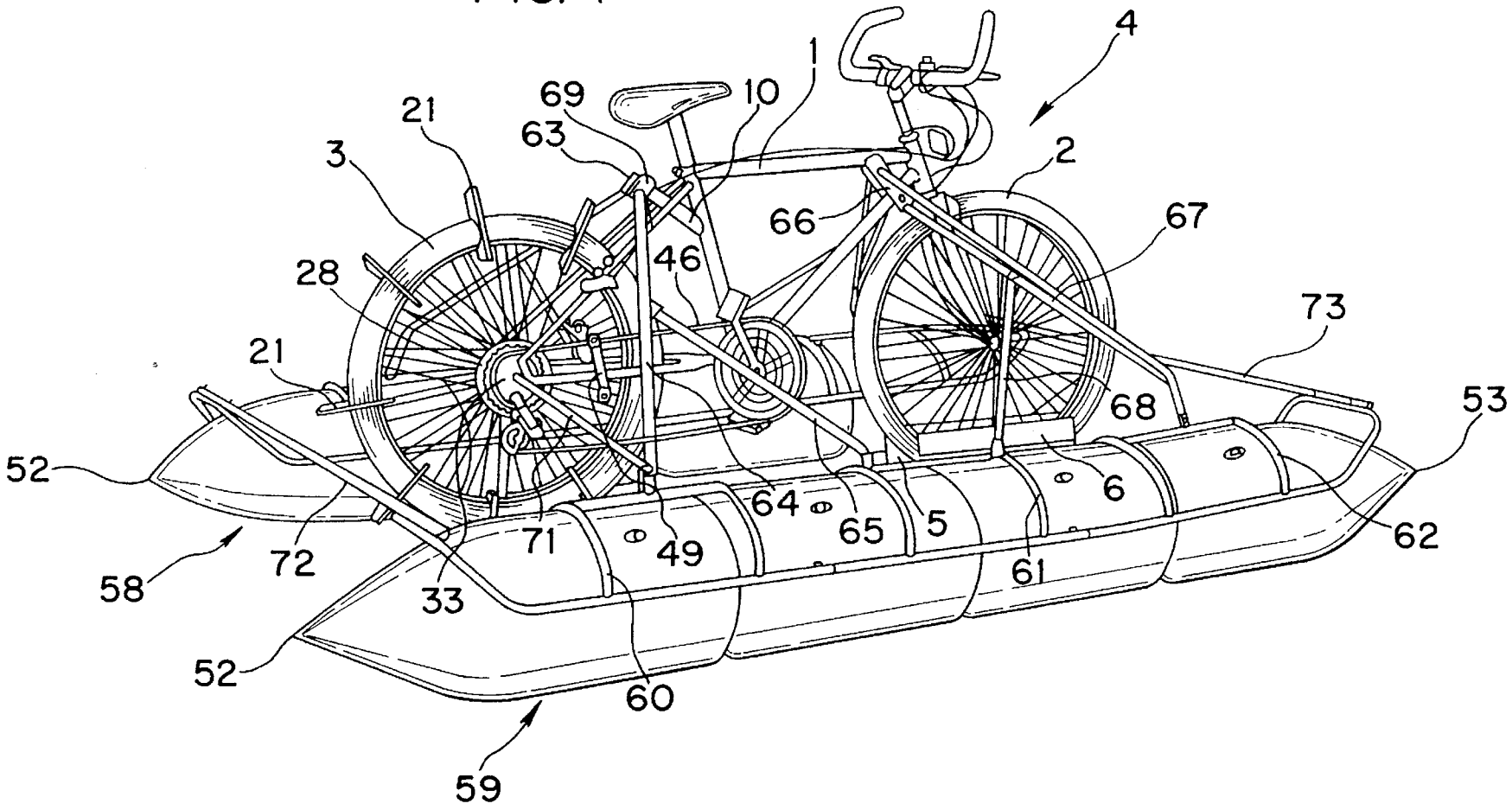
FIG. 1 is a perspective view of the amphibian bicycle according to the present invention.
Figure 2:
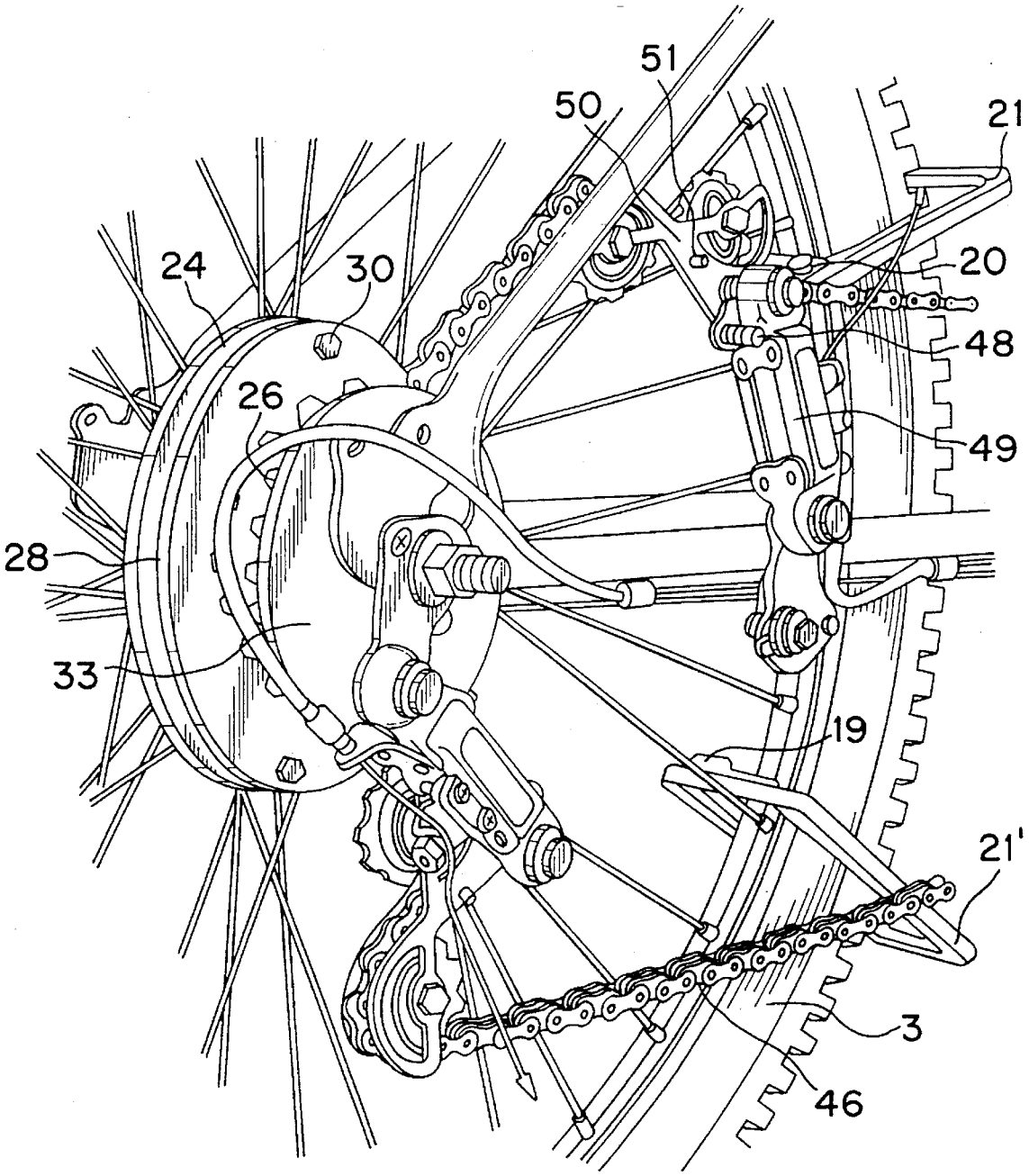
FIG. 2 is a perspective view of the principal part of a rear wheel member of the amphibian bicycle according to the present invention.
Figure 3:
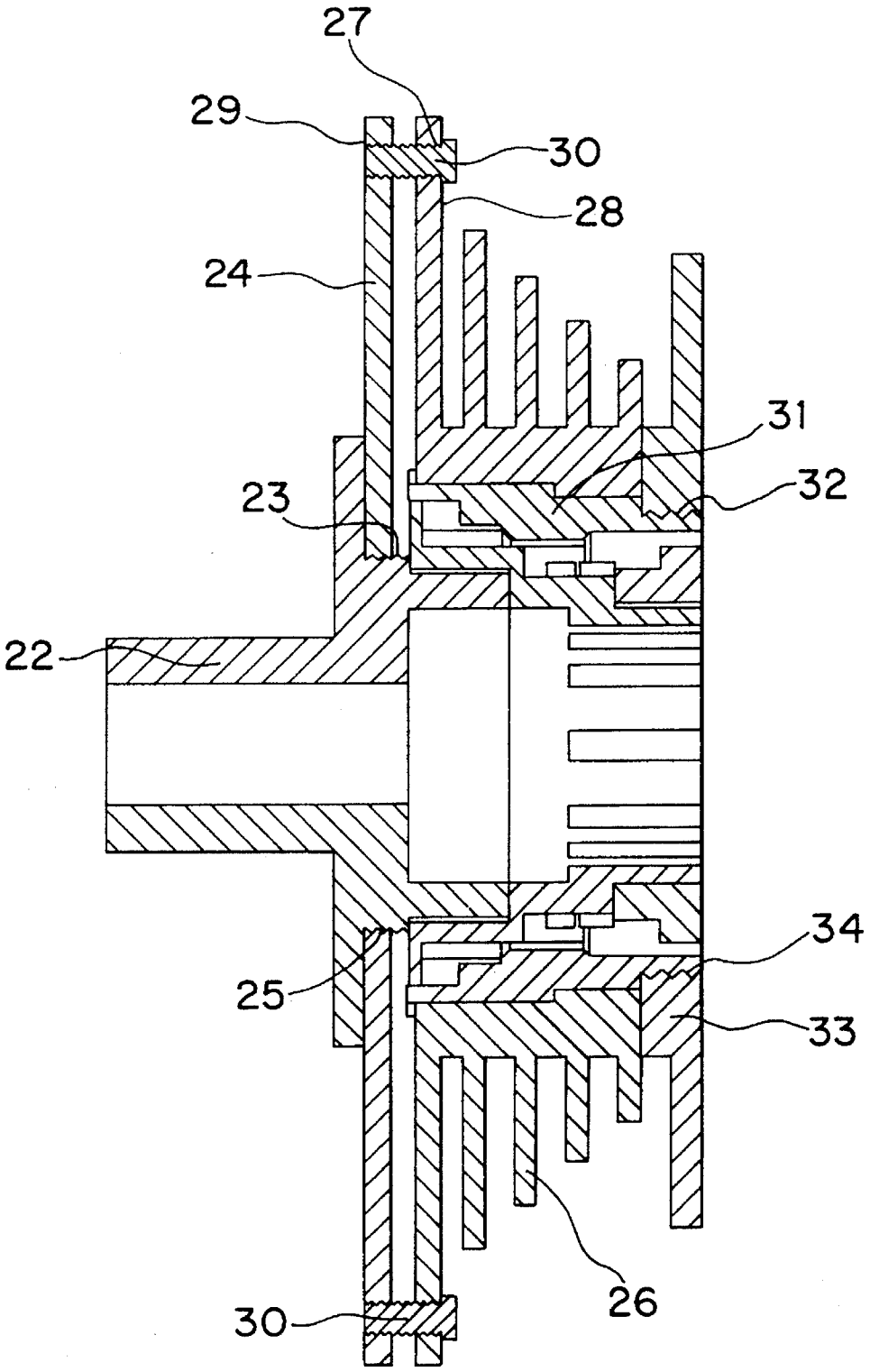
FIG. 3 is an enlarged cross-sectional view of the chain gear part according to the present invention.
Figure 4:
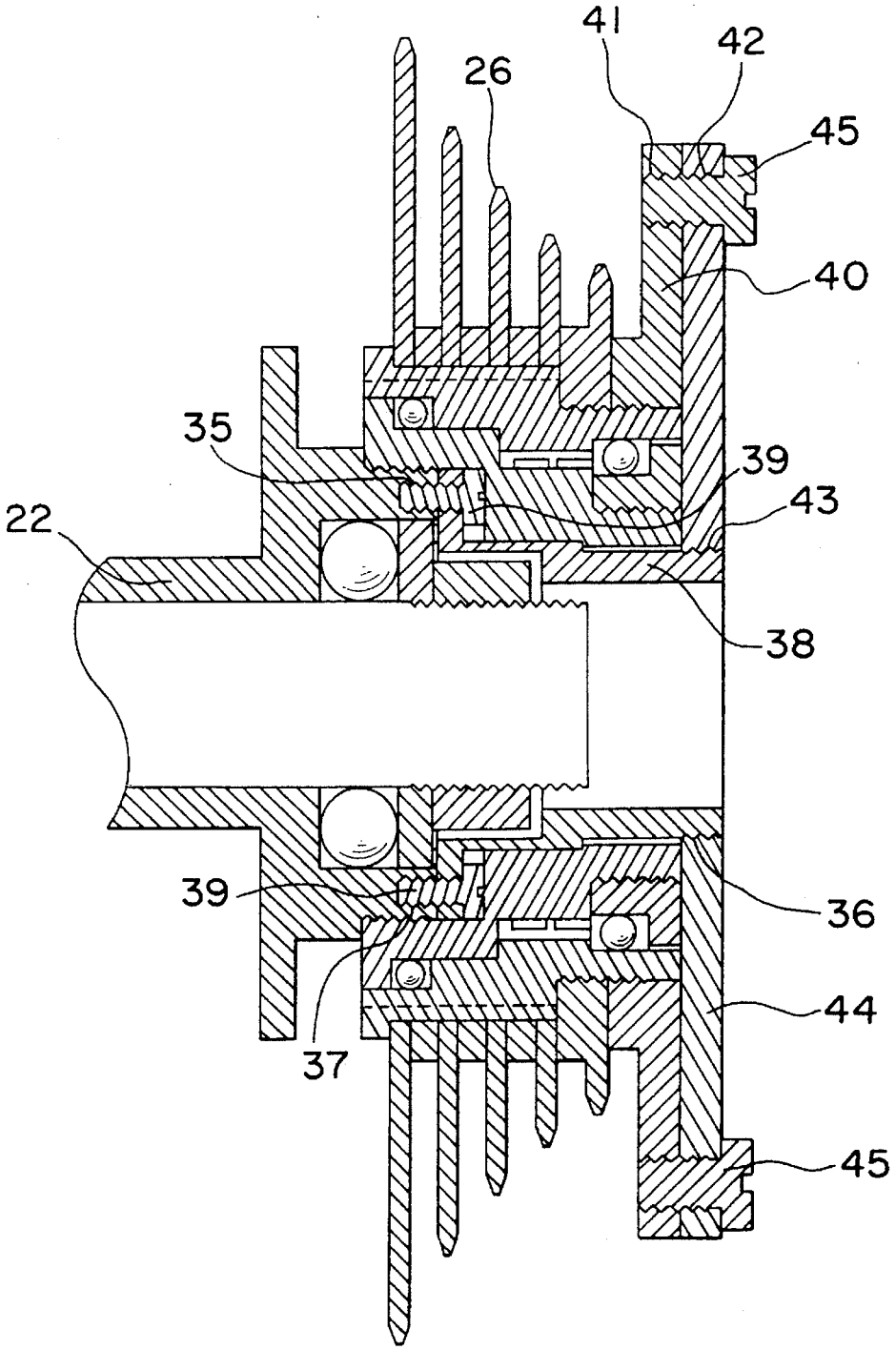
FIG. 4 is an enlarged cross-sectional view of the another embodiment of the chain gear part according to the present invention.
Figure 5:
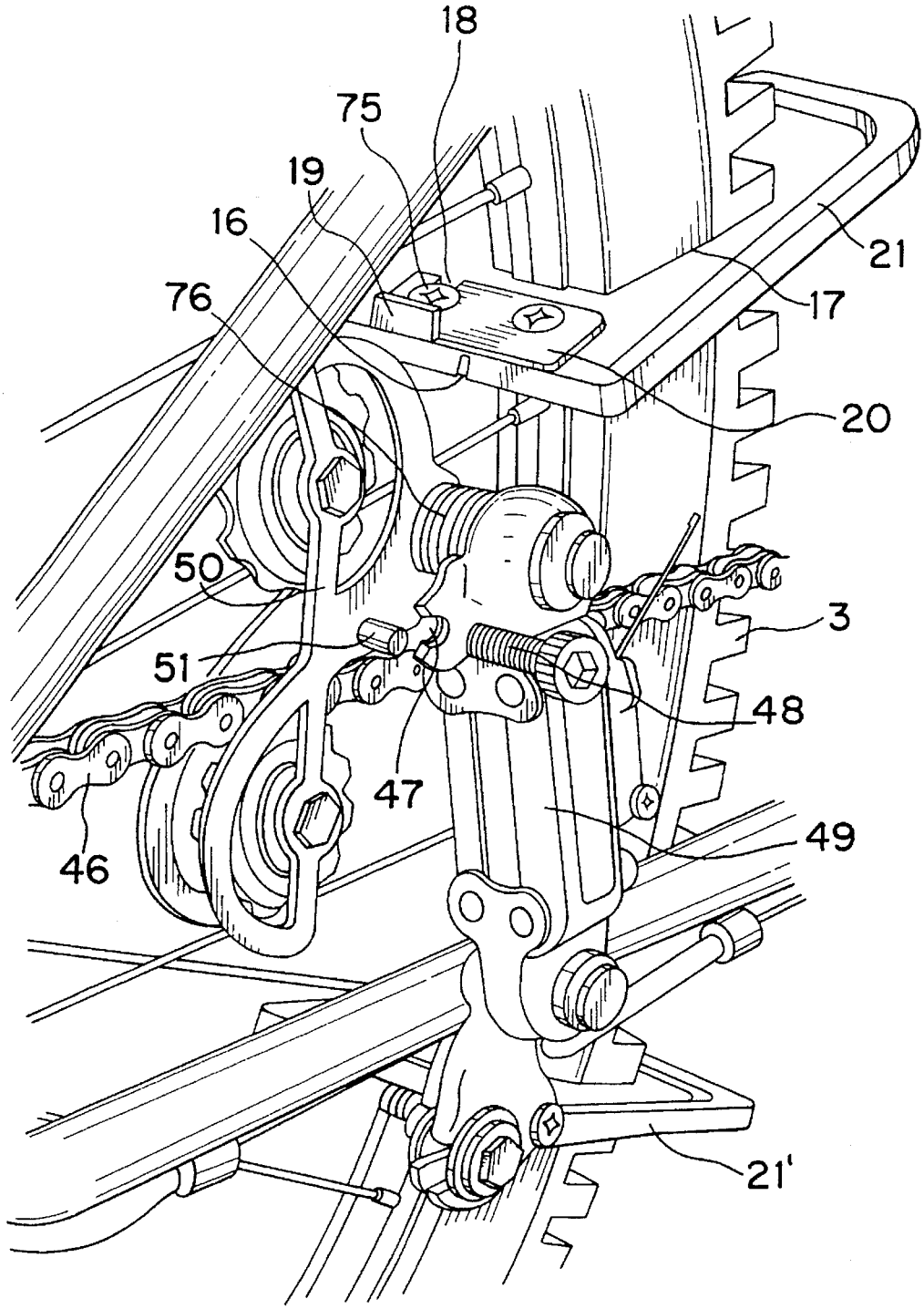
FIG. 5 is a partially cut-away perspective view of the chain-adjusted speed controller according to the present invention.

Also, as shown in FIG. 4, the fixing bolt 39 is fastened in the screw hole 35 of the hub 22 through the screw hole 37 of the joint flange 38 and the central screw portion 43 of the medium circular disc plate 41 is fixed by the end screw portion 36 of the joint flange 38 to align the screw hole 41 of the medium circular disc plate 40 and the screw hole 42 and couple them with the fixing bolt 45. When pedalling in the forward direction on water in the state wherein the semi-circle frames 60, 61 and 62, the fixing pipes 64, 67, 72 and 73 and the auxiliary pipes 65, 68 and 71 are fixed on air tubes 58 and 59 at both sides of the bicycle, the balance is smoothly maintained, and at the same time the forward motion is achieved, as described above. When pedalling backward, if the backward motion is required, the chain-adjusted speed controller 49 elastically adjusts the droop of the chain 46, and the fixing bolt 39 is fixed through the screw hole 35 of the inside of the hub 22 and the screw hole 37 of the joint flange 38. And when rotated in the same direction as that of the rear wheel 3, the screw portion 36 of the joint flange 38 and the central screw portion 43 of the medium circular disc plate 44, having the screw portions formed in the opposite direction to the screw direction of the gear 26, are coupled and the screw holes 41 and 42 of the medium circular disc plates 40 and 44 are fixed by the fixing bolt 45. Thus the loosening of the screw is prevented.

Figure 7:
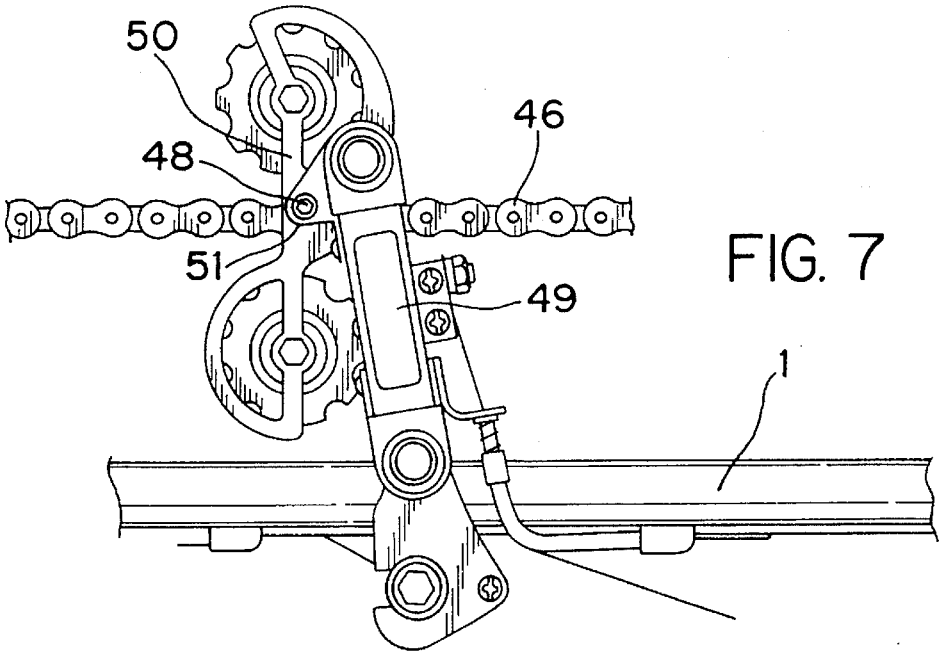
FIG. 7 is a front view showing the operating status of the chain-adjusted speed controller and the chain according to the present invention during the forward motion on land.
Figure 8A:
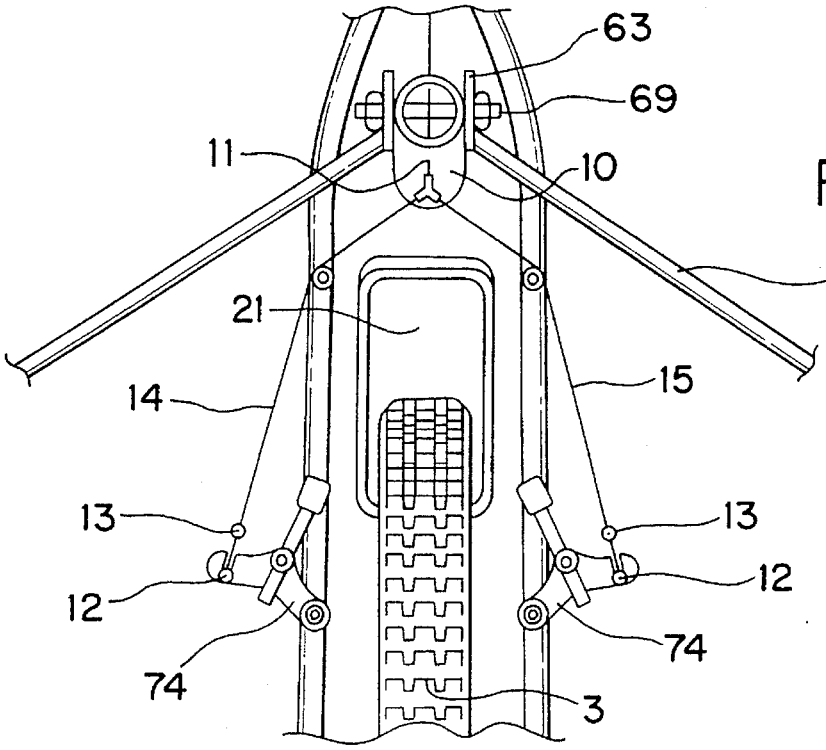
FIG. 8 shows the operating status of the brake system according to the present invention.
Figure 8B:
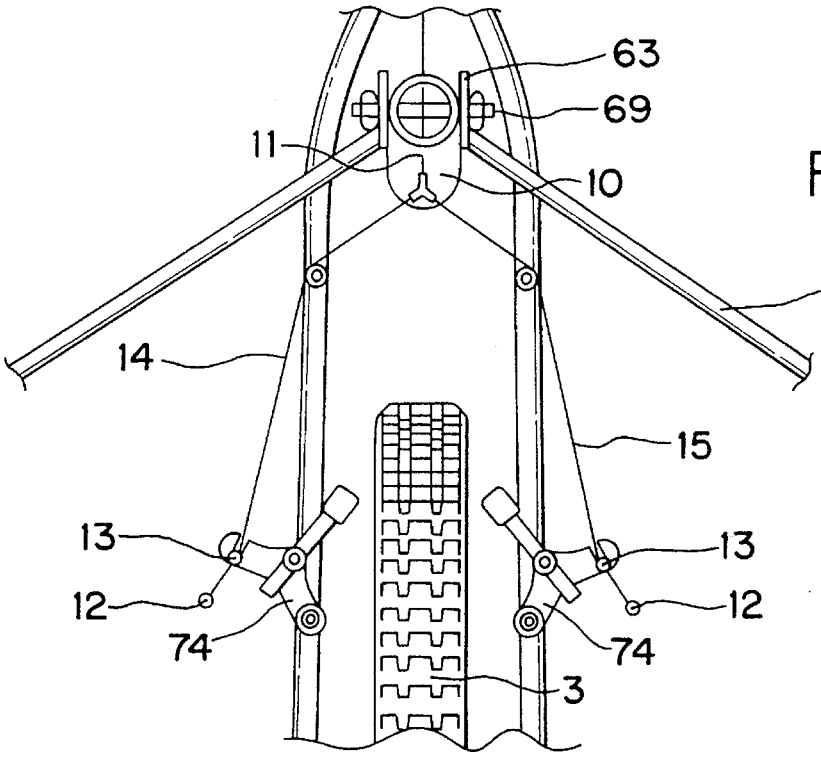

When switching over from water operation to land operation, the fixing pipes 72 and 73 are dismantled. The bolt 69 to the projecting pipe 10 and the bolt 70 to the frame 1 are unfastened to take out the fixing pipe 67. Thereafter the auxiliary pipes 71, 65 and 68 and the semi-circle frames 60, 61 and 62 are separated. The air from the air chambers 54, 55, 56 and 57 of the air tubes 58 and 59 is exhausted. The webs 21, 21' . . . are disassembled by turning the clamping hook 20 in the reverse direction by the projecting part 19 around the rear wheel 3. At the same time the direction controlling plate 6 of the front wheel 2 is separated. All the separated parts are packed into a bag (not shown in the FIGS.) and loaded onto the carrier of the bicycle 4. Furthermore, while pulling the suspension part 12 of the brake lines 14 and 15 out, the suspension part 13 of the other side may be suspended on the brake. Thereafter the bolt 30 fastening the large circular disc plates 24 and 28 of the hub 22 is released. On the other hand, in the case of the bicycle 4 having the structure as that in the embodiment shown in FIG. 4, the fixing bolt 45 coupled with the holes 41 and 42 of the medium.circular disc plates 40 and 44 is unfastened and stored. After screwing up, so that the ratchet gearing stopper 51 may be suspended to the bolt 48 by pushing down the upper moving part 50 of the chain-adjusted speed controller 49, the brake lever 9 of the handle bar 7 is released from the fixing hook 8. After finishing all the works described above, when pedalling the bicycle 4, the chain 46 as shown in FIG. 7 is passed without any influence from the chain-adjusted speed controller 49.

Accordingly, the bicycle of the present invention is operational on water or land. This amphibian bicycle is easily assembled with or disassembled from the conventional land bicycle using separate parts.

The invention being thus described, it will be obvious that the same may be varied in many ways. Such variations are not to be regarded as a departure from the spirit and scope of the invention, and all such modifications as would be obvious to one skilled in the are are intended to be included in the scope of the following claims.

What is claimed is:

1. An amphibian bicycle comprising:

a bicycle frame, a front wheel and a rear wheel mounted to the bicycle frame on front and rear wheel axles, respectfully, a direction controlling plate (6) having a tire guide (5) formed under the front wheel (2), a handle bar (7) operatively connected with the front wheel and the bicycle frame and provided with a fixing hook (8) and a brake lever (9), a projecting pipe (10) extending from the bicycle frame, said projecting pipe containing a through hole (11), brake means (74) mounted on the bicycle frame, said brake means being provided with suspension elements (12) and (13) which extend from both sides of the rear wheel, and brake lines (14) and (15) which pass through the through hole (11), and the suspension elements (12) and (13) for connecting the brake means to the brake lever (9), a plurality of webs (21, 21) positioned at equi-distance around the rear wheel (3), a hub (22) disposed on the rear wheel (3) having a screw portion (23) on the outside thereof, said hub being coupled with a central screw portion (25) of a large circular disc plate (24), having a screw hole (29) and an additional large circular disc plate (28) provided with a bolt guide hole (27) at the inside of a connected gear (26), a bolt (30) fastening the large circular disc plate (24) through the screw hole (29) to the disc plate (28), a screw portion (32) disposed around the end portion of an inner body (31) of the gear (26) in screw engagement with a central screw portion (34) of a small circular disc plate (33), a chain-adjusted speed controller (49) mounted on the frame (1) in operative association with a rear chain (46), air tubes (58) and (59) laterally disposed on both sides of the bicycle, said air tubes having projecting portions (52) and (53) extending from the ends of said air tubes, said air tubes having a multiplicity of air chambers (54), (55), (56), and (57) on which equi-divided semi-circular frames (60), (61), and (62) are held, a fixing pipe (64) and an auxiliary pipe (65) integrally formed with a fixing piece (63) and linked with the projecting pipe (10), a fixing pipe (67) and an auxiliary pipe (68) integrally formed with the semi-circular frames (60) and (61) and a fixing piece (66) linked with the upper and lower parts of the frame and semi-circular frames (61) and (62) by bolts (69) and (70), and an auxiliary pipe (71) coupled with the rear wheel axle in which the front and rear sides thereof are fixed by a fixing pipes (72) and (73).

2. The amphibian bicycle of claim 1, wherein each of the webs is provided with a clamping hook (20) having an inner guide (18) and a projecting part (19).

3. The amphibian bicycle of claim 1, wherein multiple screw holes (35) are formed around the inner portion of the hub (22) and a screw portion (36) is provided around the outer portion thereof, a joint flange (38) with screw holes (37) facing the screw holes (35) being fastened by a fixing bolt (39), and a medium circular disc plate (40) fixed together with the gear (26) is fastened with a facing medium circular disc plate (44) having central screw portion (43) by fixing bolts (45).

4. The amphibian bicycle of claim 1, wherein a bolt (48) is inserted through a screw hole of the chain-adjusted speed controller (49) in a ratchet gearing stopper (51) of an upper moving part (50).

* * * * *